US007709762B2

(12) United States Patent
Lin et al.

(10) Patent No.: US 7,709,762 B2
(45) Date of Patent: May 4, 2010

(54) KEYBOARD

(75) Inventors: Shin-Chan Lin, Taipei County (TW); Chih-Chung Yen, Taoyuan Country (TW); Yi-Chen Wang, Tainan County (TW); Ling-Hsi Chao, Taoyuan Country (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 12/189,071

(22) Filed: Aug. 8, 2008

(65) Prior Publication Data

US 2009/0038923 A1 Feb. 12, 2009

(30) Foreign Application Priority Data

Aug. 9, 2007 (TW) ..... 96213110 U

(51) Int. Cl.
*H01H 13/70* (2006.01)

(52) U.S. Cl. ..... 200/344; 200/345

(58) Field of Classification Search ..... 200/344, 200/345

See application file for complete search history.

(56) References Cited

U.S. PATENT DOCUMENTS 5,813,521 A * 9/1998 Koike et al. ..... 200/344
6,020,565 A * 2/2000 Pan ..... 200/344
6,064,020 A * 5/2000 Yamada et al. ..... 200/344
6,444,933 B1 * 9/2002 Chun ..... 200/344

* cited by examiner

*Primary Examiner*—Michael A Friedhofer
*Assistant Examiner*—Lheiren Mae A Caroc
(74) *Attorney, Agent, or Firm*—Quintero Law Office

(57) ABSTRACT

A keyboard includes a keycap, a pivot structure, a base and an X-structure. The keycap includes a bottom surface, a first edge and a second edge. The pivot structure includes two first engaging portions and two second engaging portions. The first engaging portions are disposed on the bottom surface and have a first distance away from the first edge. The second engaging portions are respectively disposed corresponding to the first engaging portions and have a second distance away from the second edge. The base is disposed under the keycap. One end of the X-structure is connected to the pivot structure of the keycap and the other end of the X-structure is movably connected to the base, thus, the keycap moves upward and downward corresponding to the base.

8 Claims, 8 Drawing Sheets

KEYBOARD

CROSS REFERENCE TO RELATED APPLICATIONS

This Application claims priority of Taiwan Patent Application No. 096213110, filed on Aug. 9, 2007, the entirety of which is incorporated by reference herein.

BACKGROUND OF THE INVENTION

1. Field of the Invention

The present invention relates to a keyboard, and in particular relates to a keyboard applied to an electronic device.

2. Description of the Related Art

Referring to FIG. 1, a conventional keyboard 10 has a keycap 11, a base 12 and an X-structure 13. The X-structure 13 is disposed between the keycap 11 and the base 12. The keycap 11 has a pivot structure 111, a bottom surface 114, a first edge 115 and a second edge 116. The pivot structure 111 has first engaging portion 112 and a second engaging portion 113. The first engaging portion 112 is tightly connected to the first edge 115. The second engaging portion 113 is tightly connected to the second edge 116. When assembling the keyboard 10, the X-structure 13 is engaged with and pivoted on the first engaging portion 112 and the second engaging portion 113. However, the first engaging portion 112 is tightly connected to the first edge 115, and the second engaging portion 113 is tightly connected to the second edge 116, thus, the first engaging portion 112 is damaged by undue exertion when the X-structure 13 is assembled with the first engaging portion 112 and the second engaging portion 113.

BRIEF SUMMARY OF THE INVENTION

The invention provides a keyboard comprising a keycap, a pivot structure, a base, and an X-structure. The keycap comprises a bottom surface, a first edge, and a second edge. The pivot structure comprises two first engaging portions and two second engaging portions. The first engaging portions are disposed on the bottom surface and have a first distance away from the first edge. The second engaging portions are respectively disposed corresponding to the first engaging portions and have a second distance away from the second edge. The base is disposed under the keycap. The X-structure comprises two ends. One end of the X-structure is connected to the pivot structure, and the other end of the X-structure is movably connected to the base so that the keycap moves upward and downward on the base.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
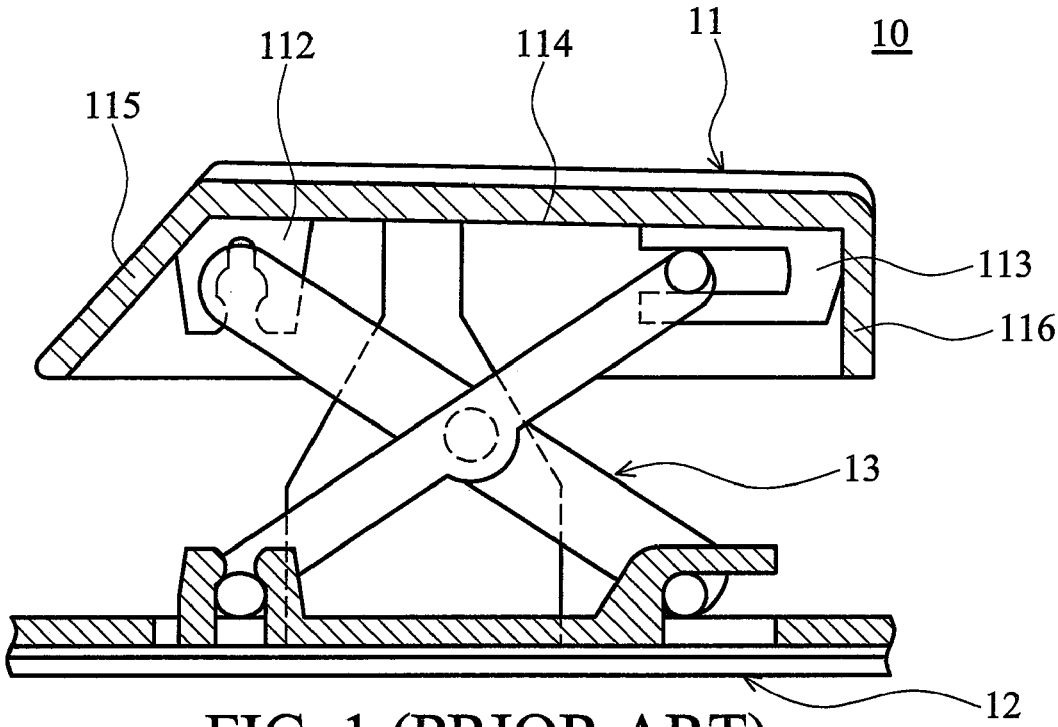
FIG. 1 (PRIOR ART)
FIG. 1 is a schematic view of a conventional keyboard.
Figure 2:
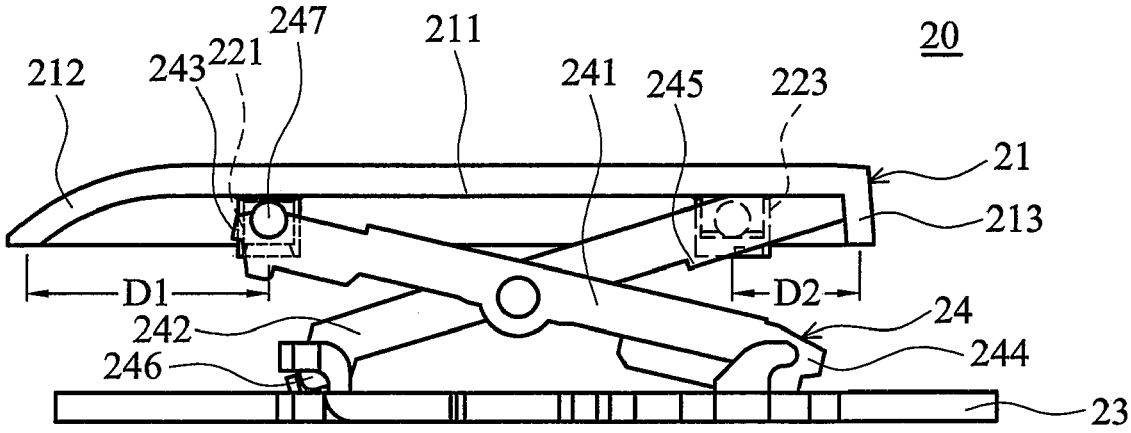
FIG. 2 is a lateral view of a keyboard of the present invention.
Figure 3:
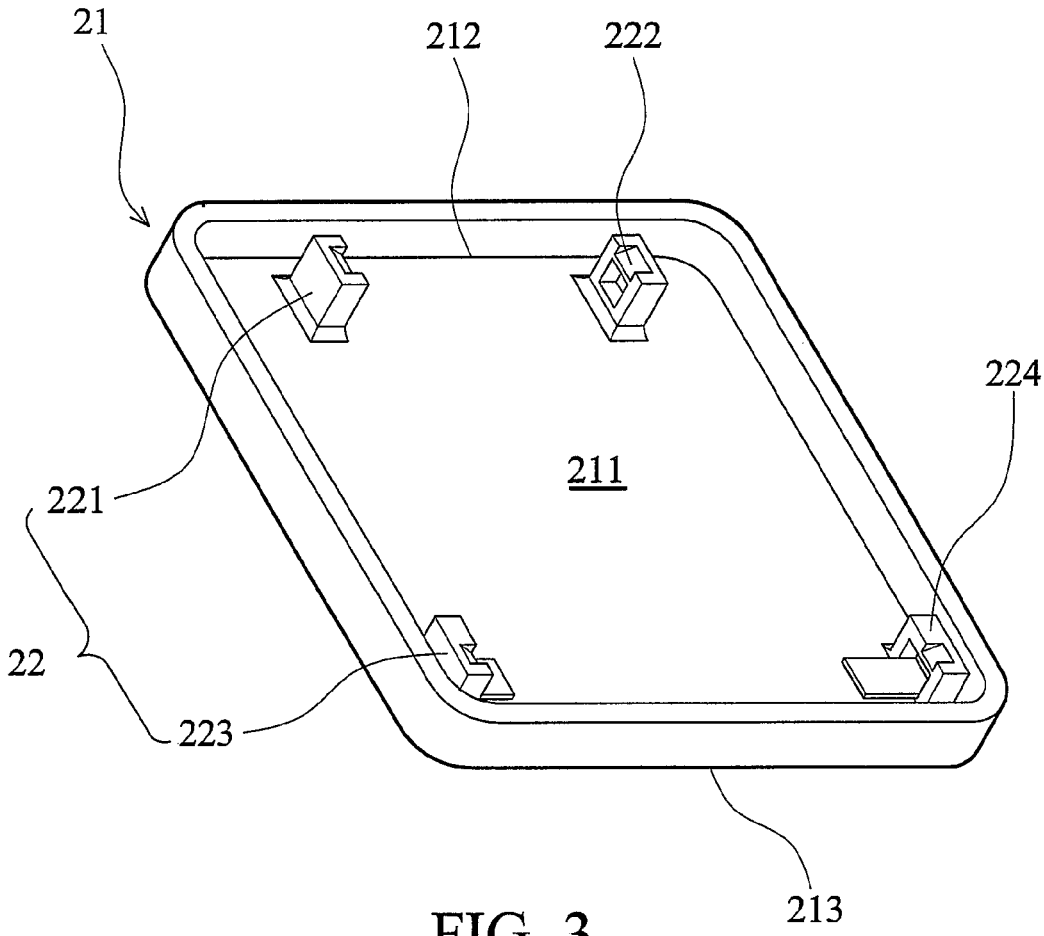
FIG. 3 is a schematic view of a keycap of the present invention.

FIG. 2 is a lateral view of a keyboard of the present invention. FIG. 3 is a schematic view of a keycap of the present invention. Referring to FIGS. 2 and 3, the keyboard 20 comprises a keycap 21, a pivot structure 22, a base 23, and an X-structure 24. The keycap 21 comprises a bottom surface 211, a first edge 212, and a second edge 213. The pivot structure 22 comprises two first engaging portions 221 and 222 and two second engaging portions 223 and 224. The base 23 is disposed under the keycap 21. The X-structure 24 is disposed between the base 23 and the keycap 21 and comprises two ends. One end of the X-structure 24 is connected to the pivot structure 22, and the other end of the X-structure 24 is movably connected to the base 23 so that the keycap 21 moves upward and downward on the base 23.

Referring to FIG. 2, the X-structure 24 comprises a first connecting member 241 and a second connecting member 242. The first connecting member 241 comprises a first upper end 243 and a first lower end 244. The second connecting member 242 comprises a second upper end 245 and a second lower end 246. The first connecting member 241 is rotatably connected to the second connecting member 242. The first upper end 243 comprises two pivot axles 247 disposed on the two sides thereof. When assembling, the pivot axle 247 of the first upper end 243 is pressed into and engaged with the first engaging portion 221. The pivot axle 247 is rotatably connected to the first engaging portion 221. The second upper end 245 is slidably connected to and pivoted on the second engaging portions 223. The first lower end 244 and the second lower end 246 are rotatably and slidably connected to the base 23.

Figure 4A:
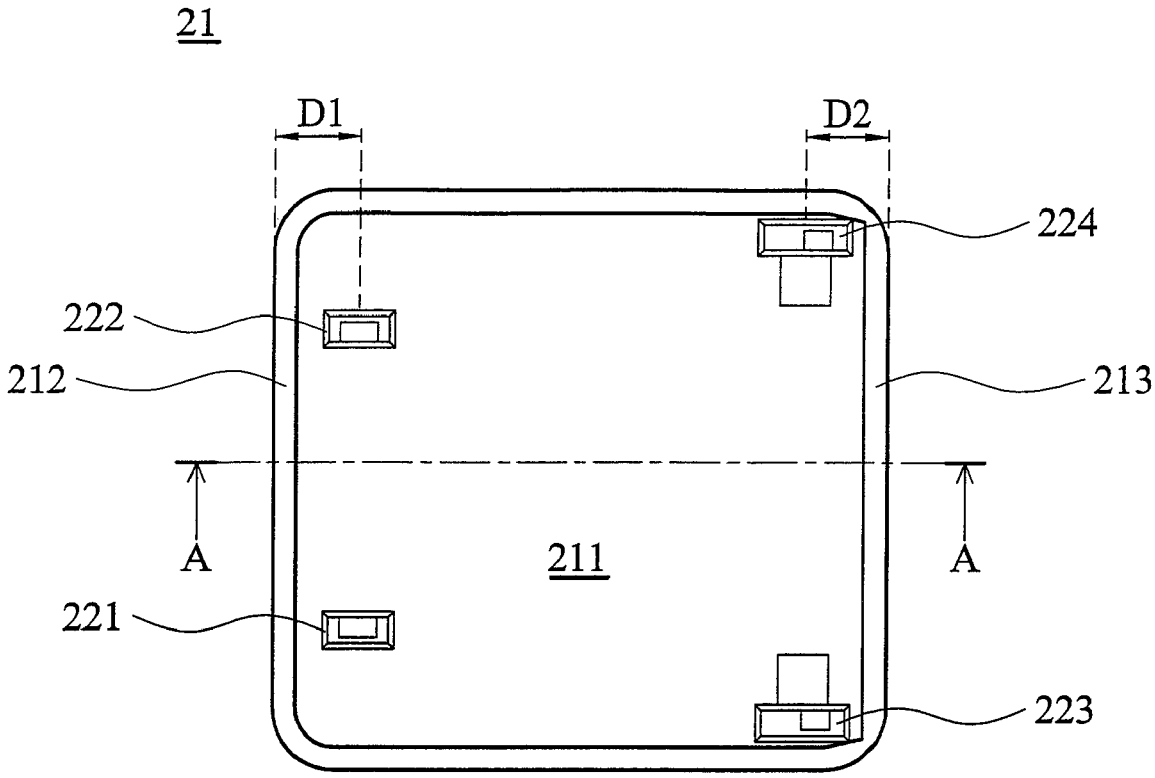
FIG. 4A is an upward view of a keycap of the present invention.
Figure 4B:
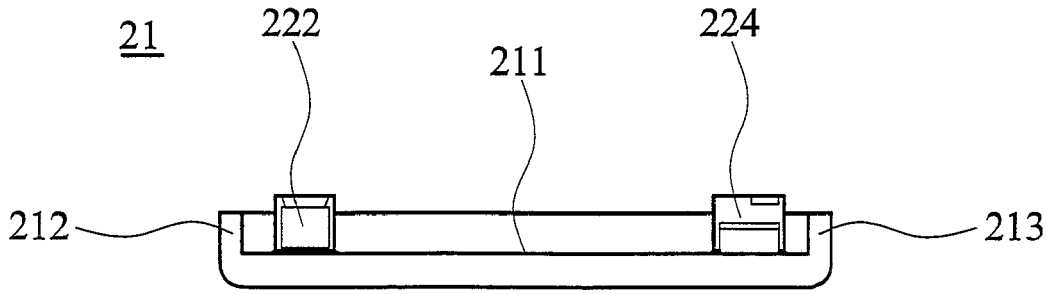
FIG. 4B is a cross-sectional view along A-A line in FIG. 4A.

FIG. 4A is an upward view of a keycap of the present invention. FIG. 4B is a cross-sectional view along A-A line in FIG. 4A. The first engaging portions 221 and 222 are disposed on the bottom surface 211 and have a first distance D1 away from the first edge 212. The second engaging portions 223 and 224 are respectively disposed on the bottom surface 211 corresponding to the first engaging portions 221 and 222 and have a second distance D2 away from the second edge 213.

Figure 5A:
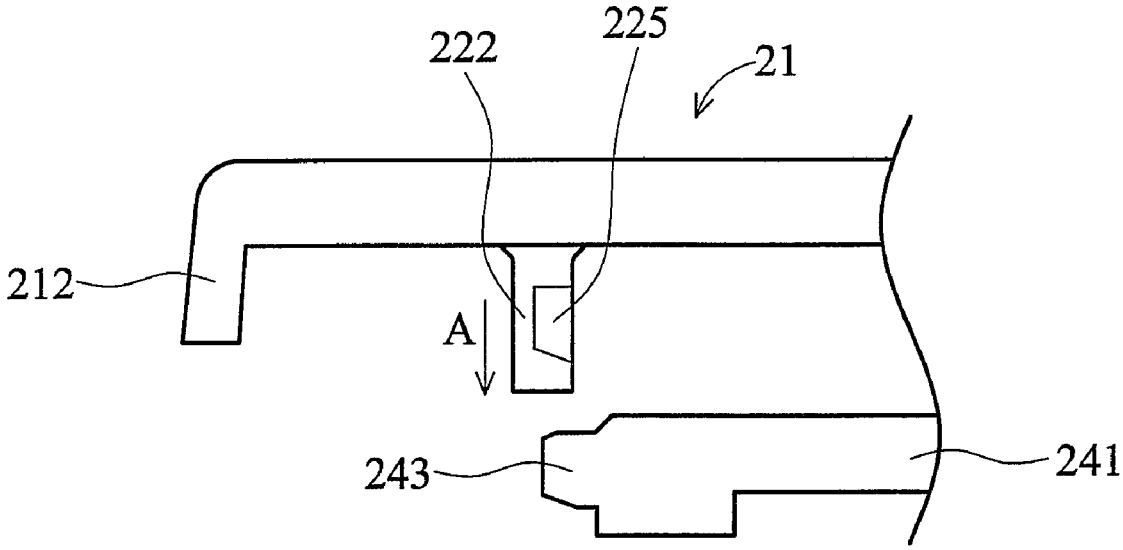
FIGS. 5A-5D are continuous views showing assembly of a keyboard of the present invention.
Figure 5B:
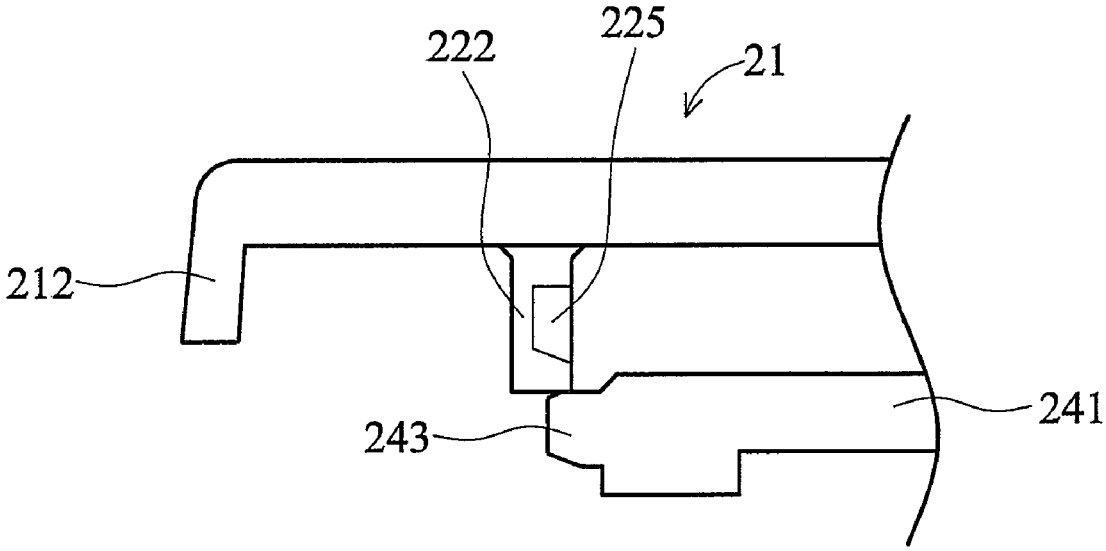
Figure 5C:
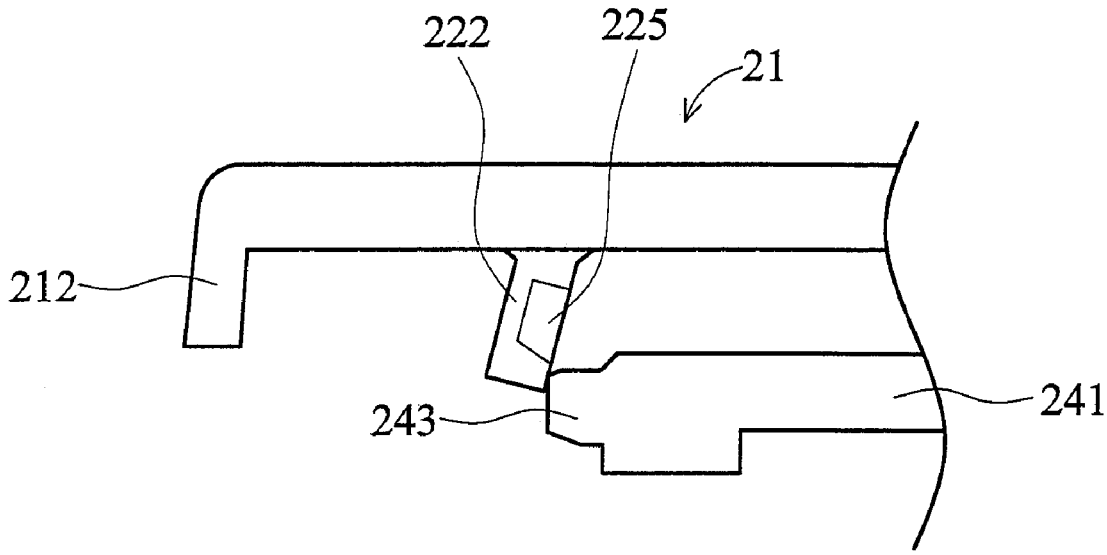
Figure 5D:
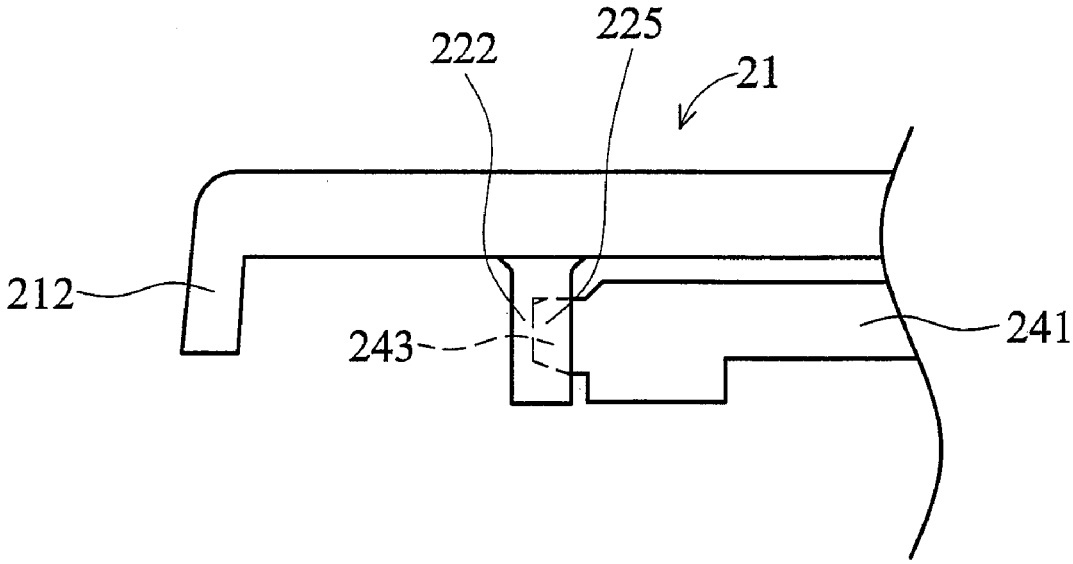

FIGS. 5A-5D are continuous views showing assembly of a keyboard of the present invention. The first engaging portion 222 comprises a groove 225 and the first engaging portion 222 comprises also comprises a groove (not shown). Referring to FIG. 5A, the keycap 21 approaches the first upper end 243 on the first connecting member 241 of the X-structure 24 along an arrow A until the first engaging portion 222 contacts with the first upper end 243 (shown in FIG. 5B). Referring to FIG. 4C, the keycap 21 continues to be pressed downward, and then the first upper end 243 pushes the first engaging portion 222 along an arrow B, that is, the first engaging portion 222 rotates along the arrow B. Note that the first engaging portions 221 and 222 are flexible in this embodiment. Due to the first distance D1 between the first engaging portion 222 and the first edge 212, the first engaging portion 222 has enough space therebetween for rotation. Moreover, the groove 225 disposed on the first engaging portion 222 accommodates the first upper end 243. When the first upper end 243 enters the groove 225, the flexible first engaging portion 222 springs back along an arrow C. At this time, the groove 225 is engaged with the first upper end 243, thus, the keycap 21 is fixed to the first connecting member 241 of the X-structure 24. Note that FIGS. 5A-5D only disclose connection of the first engaging portion 222 and one side of the first upper end 243, and connection of the first engaging portion 221 and the other side of the first upper end 243 similar to FIGS. 5A-5D is omitted for brevity.

The keyboard 20 of the present invention provides a first distance D1 between the first engaging portions 221 and 222 and the first edge 212, and the first engaging portions 221 and 222 are made of flexible material. Thus, when assembling the keycap 21 and the X-structure 24, allowance is provided for deformation of the first engaging portions 221 and 222 so that the first upper end 243 of the X-structure 24 is easy to be fixed to the first engaging portions 221 and 222 of the keycap 21.

Figure 6:
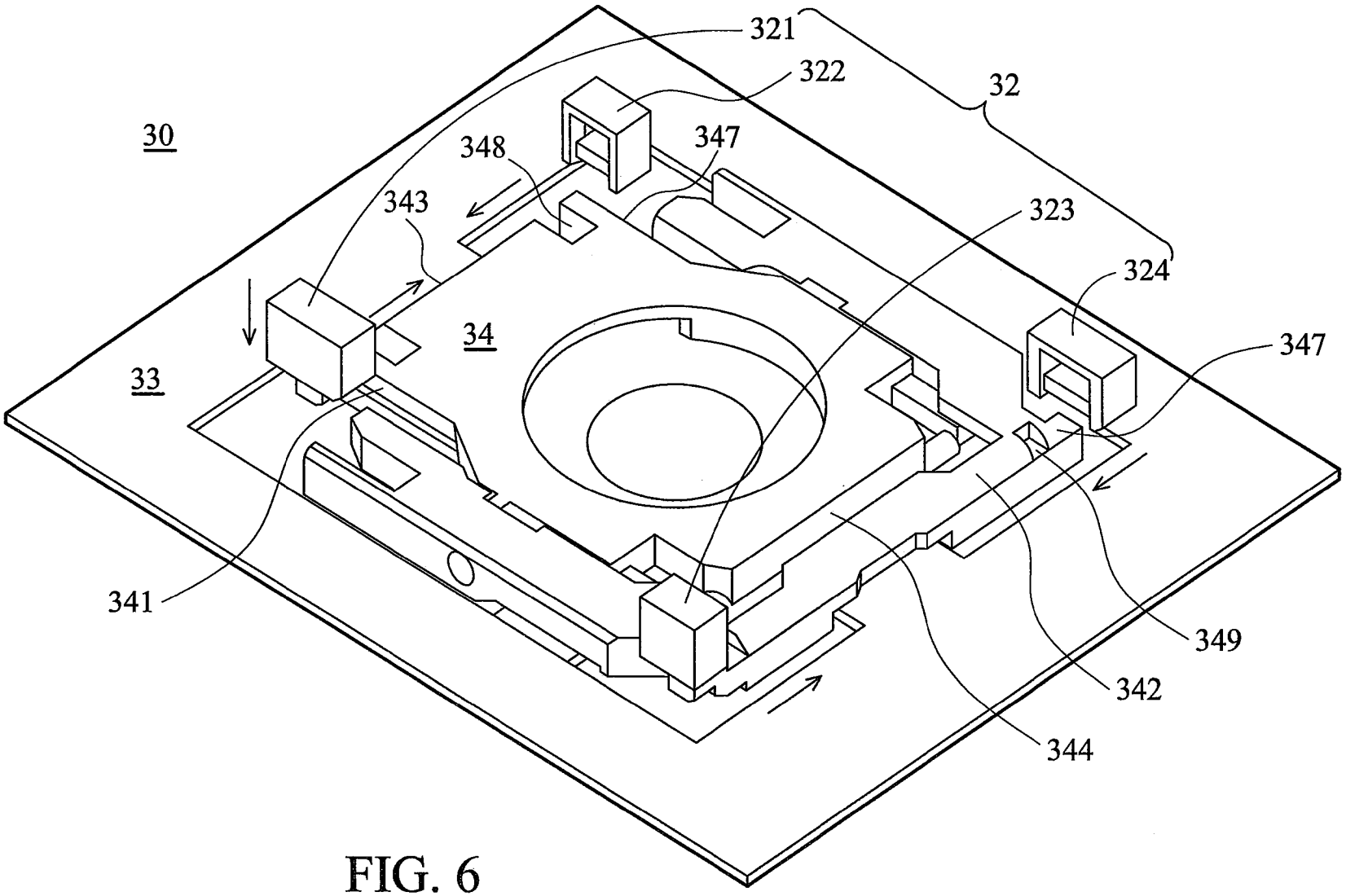
FIG. 6 is a schematic view of another embodiment of a keyboard of the present invention.

FIG. 6 is a schematic view of another embodiment of a keyboard of the present invention. The keyboard 30 comprises a keycap (not shown), a pivot structure 32, a base 33 and an X-structure 34. The pivot structure 32 comprises two first engaging portions 321 and 322 and two second engaging portions 323 and 324. One end of the X-structure 34 is connected to the pivot structure 32, and the other end of the X-structure 34 is connected to the base 33.

Figure 7:
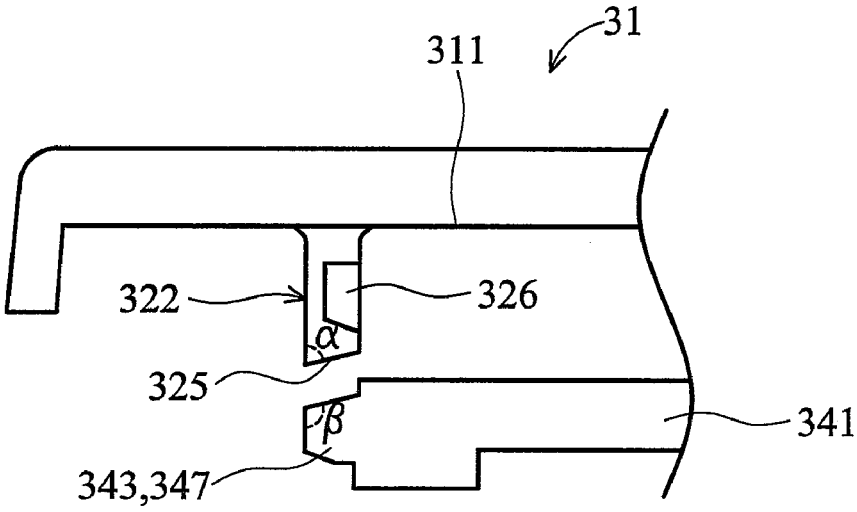
FIG. 7 is a lateral view of a keyboard of another embodiment of the present invention.

The X-structure 34 comprises a first connecting member 341 and a second connecting member 342. The first connecting member 341 comprises a first upper end 343 and a first lower end 344. The first connecting member 341 is rotatably connected to the second connecting member 342. When assembling, two ends of the first upper end 343 are pressed and slidably connected to the first engaging portions 321 and 322. Two ends of a lower end of the second connecting member 342 are pressed, rotatably connected to and pivoted on the second engaging portion 323 and 324. This embodiment is approximately similar to the embodiment in FIG. 2. FIG. 7 is a lateral view of a keyboard of another embodiment of the present invention. Referring to FIG. 7, the difference is that the first engaging portion 322 comprises a guiding portion 325 and a groove 326. The groove 326 and the guiding portion 325 adjacent to the groove 326 are disposed on a bottom surface 311 of the keycap 31. The bottom of the guiding portion 325 comprises a first lead angle $\alpha$ and a pivot axle 347 of the first upper end 343 comprises a second lead angle $\beta$ corresponding to the first engaging portion 322. The first lead angle $\alpha$ and the second lead angle $\beta$ provides a better angle for assembly so that the pivot axle 347 slides smoothly into the groove 326.

Referring to FIG. 6, the first connecting member 343 and the second connecting member 344 respectively comprise two recesses 348 and 349 near the pivot axle 347. The recesses 348 and 349 are symmetrically disposed. When the X-structure 34 are assembled with the first engaging portions 321 and 322 and the second engaging portion 323 and 324, the recesses 348 and 349 are pressed so that the pivot axle 347 moves along arrows toward the middle of the X-structure 34. Thus, the X-structure 34 is easily assembled with the pivot structure 32. Note that the guiding portion 325 and the groove 326 is a unitary and single member.

Figure 8:
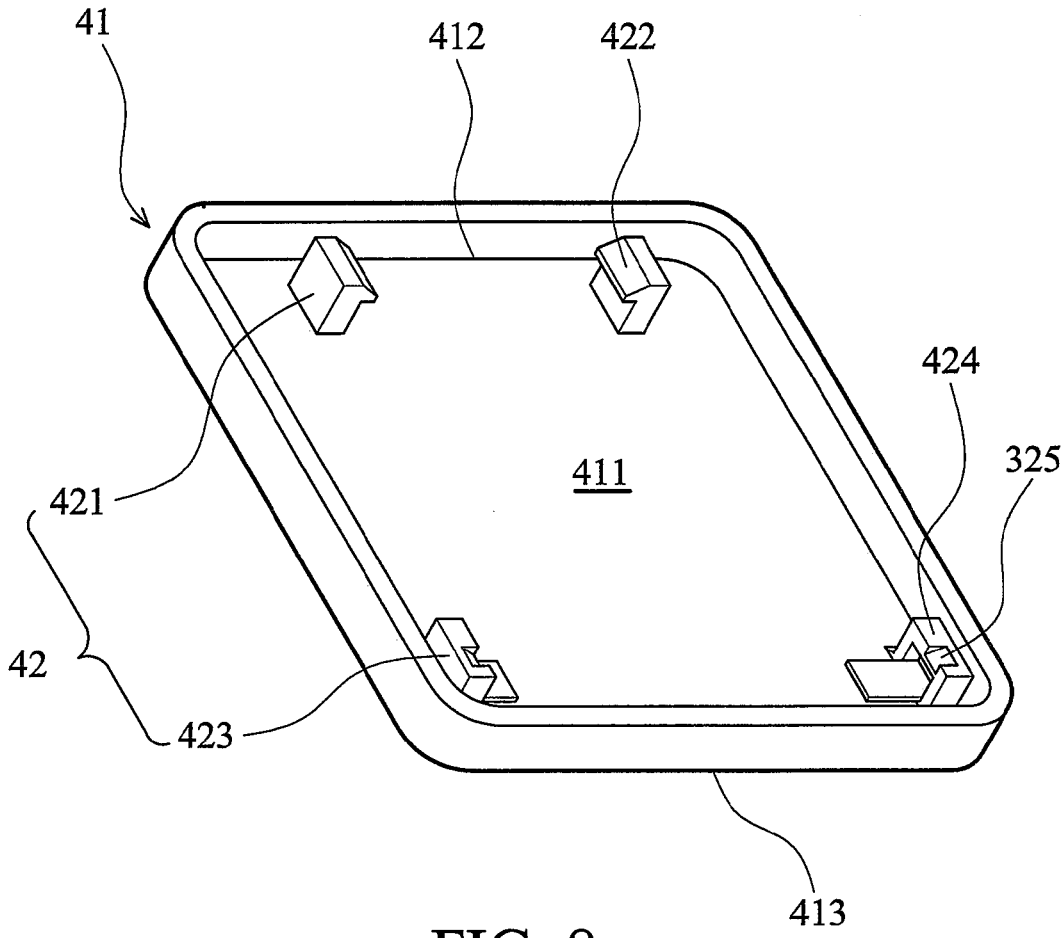
FIG. 8 is a schematic view of a keycap of another embodiment of the present invention.

FIG. 8 is a schematic view of a keycap of another embodiment of the present invention. The keycap 41 comprises a bottom surface 411, a first edge 412 and a second edge 413. The pivot structure 42 comprises two first engaging portions 421 and 422 and two second engaging portions 423 and 424. In this embodiment, the shapes of the first engaging portions 421 and 422 are hook-shaped for assembling with the X-structure (not shown). Assembly of the keyboard is approximately similar to the description as above, thus, it is omitted for brevity.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A keyboard, comprising:

a keycap comprising a bottom surface, a first edge and a second edge;

a pivot structure comprising:

two first engaging portions disposed on the bottom surface and having a first distance away from the first edge, wherein the first engaging portions comprise two grooves, and wherein each first engaging portion comprises a first lead angle disposed on the lower side of the first engaging portion; and two second engaging portions respectively disposed corresponding to the first engaging portions and having a second distance away from the second edge;

a base disposed under the keycap; and an X-structure comprising two ends, wherein one end of the X-structure is connected to the pivot structure, and the other end of the X-structure is movably connected to the base so that the keycap moves upward and downward on the base, and wherein the X-structure comprises:

a first connecting member comprising a first upper end and a first lower end; and a second connecting member comprising a second upper end and a second lower end, wherein the first upper end comprises two pivot axles, each pivot axle comprising a second lead angle disposed corresponding to the lower side of the first engaging portions;

wherein the pivot axles are pressed and engaged with the grooves of the first engaging portions, the pivot axles are slidable in the grooves, and the second upper end is rotatably connected to and pivoted on the second engaging portions.

2. The keyboard as claimed in claim 1, wherein each first engaging portion comprises a first lead angle disposed on the lower side of the first engaging portion.

3. The keyboard as claimed in claim 1, wherein each first engaging portion comprises a guiding portion, and the first lead angle is disposed on the guiding portion.

4. The keyboard as claimed in claim 3, wherein each first engaging portion comprises a groove, and the guiding portion and the groove are adjacent and disposed on the bottom surface of the keycap.

5. The keyboard as claimed in claim 3, wherein the guiding portion and the groove is a unitary and single member.

6. The keyboard as claimed in claim 1, wherein the first engaging portions are flexible.

7. The keyboard as claimed in claim 1, wherein the first connecting member and the second connecting member respectively comprise a recess near the pivot axles.

8. The keyboard as claimed in claim 1, wherein the first lower end and the second lower end are rotatably and slidably connected to the base.

* * * * *